US005267405A

United States Patent [19]

Seggerson

[11] Patent Number: 5,267,405

[45] Date of Patent: Dec. 7, 1993

[54] INTERCHANGEABLE SIGN SYSTEM AND MODULAR DIGIT CARRIER THEREFOR

[75] Inventor: Patrick J. Seggerson, Villa Hills, Ky.

[73] Assignee: Dualite, Inc., Williamsburg, Ohio

[21] Appl. No.: 365,248

[22] Filed: Jun. 12, 1989

[51] Int. Cl.[5] ..... G09F 7/02

[52] U.S. Cl. ..... 40/618; 40/5; 40/611; 40/657

[58] Field of Search ..... 40/642, 649, 650, 651, 40/652, 653, 654, 657, 605, 618, 620, 124, 124.2, 124.4, 661, 5, 576, 575, 577, 611, 619, 596, 552, 491, 490, 489, 122

[56] References Cited

U.S. PATENT DOCUMENTS

| | | | |
|---|---|---|---|
| D. 279,587 | 7/1985 | Seggerson et al. . | |
| 2,105,594 | 1/1938 | Heimrich | 40/124.2 |
| 2,342,847 | 2/1944 | Crosby | 40/140 |
| 2,928,198 | 3/1960 | Madanick . | |
| 3,315,392 | 4/1967 | Edwards | 40/143 |
| 3,458,945 | 8/1969 | Edwards | 40/140 |
| 3,553,870 | 1/1971 | Rudolph | 40/576 |
| 3,685,186 | 8/1972 | Goodman | 40/140 |
| 3,742,633 | 7/1973 | Palm | 40/133 B |
| 3,890,728 | 6/1975 | Schubert | 40/140 |
| 4,367,604 | 1/1983 | Porter et al. | 40/618 |
| 4,497,125 | 2/1985 | Hutchinson | 40/657 |
| 4,593,486 | 1/1986 | Visocky et al. | 40/5 |
| 4,682,430 | 7/1987 | Ramsay | 40/5 |
| 4,693,026 | 9/1987 | Callahan et al. | 40/576 |
| 4,765,080 | 8/1988 | Conti | 40/576 |
| 4,814,316 | 4/1989 | Walker | 40/5 |

FOREIGN PATENT DOCUMENTS

| | | | |
|---|---|---|---|
| 6402354 | 9/1965 | Netherlands | 40/490 |
| 11881 | of 1894 | United Kingdom | 40/611 |

*Primary Examiner*—Laurie K. Cranmer
*Attorney, Agent, or Firm*—Frost & Jacobs

[57] ABSTRACT

A modular digit carrier for a sign system having a sign face upon which a plurality of digits can be secured. In a preferred embodiment, the digit carrier includes a rear surface and a front surface, and outwardly extending flanges for securing the digit carrier with its rear surface adjacent the sign face. The digit carrier further preferably includes a substantially frame-like body portion which defines a support channel and which provides access to an interchangeable digit supported by the carrier from the front surface of the digit carrier. The support channel slidingly supports the indicia digit and includes an open slot through which the digit can be inserted and removed in a direction which is oriented so as to allow the insertion and removal of a digit from the carrier without removing the carrier from the sign face. The digit carrier can also be configured to allow backlighting of the indicia digit supported. In one preferred embodiment, the sign system includes a plurality of vertically spaced longitudinal slots defined between pairs of longitudinal tracks within which the digit carriers are slidably received, and the distal portions of the tracks are covered with opaque material to prevent leakage of backlighting.

19 Claims, 3 Drawing Sheets

INTERCHANGEABLE SIGN SYSTEM AND MODULAR DIGIT CARRIER THEREFOR

TECHNICAL FIELD

This invention relates to display sign systems for use in restaurants and the like used for advertising menu items and price information, and, more particularly, to a modular digit carrier for an interchangeable display sign system which permits convenient interchangeability of sign messages from the front of the sign system and without removing the individual digit carriers therefrom.

BACKGROUND

The use of interchangeable display sign systems is widespread in a variety of retailing industries, and is especially prevalent in restaurant and similar establishments where various items and their prices are subject to change on a relatively frequent basis. In many restaurants, a display sign system is often arranged adjacent a service counter where items are ordered paid for, and delivered to the customer. Often these sign systems are backlighted with light sources mounted within the sign itself, while product and price information and similar indicia is provided as translucent characters and/or images on an otherwise opaque background, whereby the light passes through the characters and illuminates the information in contrast to its opaque surroundings.

Examples of illuminated display signs are seen in U.S. Pat. No. 3,742,633 which issued to Bernhard Palm and U.S. Pat. No. 3,458,945 which issued to L. N. Edwards. The Palm reference describes an illuminated display sign which includes individual characters which are placed between vertically spaced longitudinal rails. The rails are formed with a shallow channel in the lower rail and a deeper channel in the upper rail to enable insertion and removal of individual sign characters. In particular, removal is accomplished by sliding the sign character upwardly into the deeper channel of the upper rail until the character clears the upper portions of the lower rail, then pivoting the character inwardly toward the sign panel and sliding the lower end into the shallow channel in the lower rail. The insertion and removal of individual characters thereby requires a rather intricate set of manipulations, requiring additional labor and time to achieve sign changes. Moreover, this arrangement requires the use of a biasing means to maintain adjacent characters in a tight relationship to prevent leakage of light between the individual characters, making insertion and removal of those characters more awkward and inconvenient.

The Edwards reference describes a display sign having a plurality of longitudinal protuberances designed to receive clips which support display indicia, as shown in the earlier Edwards patent U.S. Pat. No. 3,315,392. Such a mounting system for indicia is not contemplated for use in backlighted applications, however, as light leakage between adjacent indicia characters would be unacceptable. Furthermore, the use of the protuberance/clip support arrangement for the indicia characters is unwieldy and inefficient for display signs having a relatively large amount of information and indicia characters to be supported.

U.S. Pat. No. 4,367,604, which issued to Steven T. Porter, II, on Jan. 11, 1983, is directed to a backlighted menu board which has a plurality of vertically spaced ribs on the outer surface of a sign panel, and discusses the use of information strips which are insertable between the ribs. These information strips are generally opaque and have transparent portions spelling out the name of the menu item which allow light to be passed therethrough. Porter further describes the provision of a plurality of picture display units which can be easily engaged with the flanges of two ribs of the sign, and which can be changed without dismantling a major portion of the sign. However, the Porter display sign requires its information strips to be printed or otherwise custom made for each menu item and price. Changing the information or price entails replacing the information strip with a new strip having the corrected information provided thereon. This arrangement is not only inconvenient, but can be expensive.

To overcome the problems associated with information strips which must be replaced with new strips when information is to be changed, prior art devices have also included a support strip or holder for a plurality of individual indicia characters which can be inserted and removed from the support strip. U.S. Pat. No. 4,682,430 which issued to Charles Ramsey on Jul. 28, 1987, is an example. The Ramsey patent shows a price chip support strip which provides access to the individual price chips through the upper portions of rectangular pockets provided therein. The strip itself supports a plurality of individual price chips (i.e. 5) by providing a series of price chip receptor pockets fixedly attached adjacent one another. The strip is designed to be inserted between a pair of guide tracks mounted on the rear surface of a transparent frame panel which is provided on its front face with an opaque mask which defines elongated clear panels for display of the price chip indicia held within the price chip support strip. However, it is necessary to withdraw the price chip support strip from the support frame tracks to obtain access to the individual price chips held there within. Consequently, additional labor is required when changes are desirable, as the price chip support strip must be removed from the sign system. Moreover, because the support tracks are located on the rear face of the sign panel, access to the rear of the sign is required, further complicating sign change procedures, and often requiring the sign to be partially dismantled or opened.

Similar problems are encountered in making changes to signs such as those disclosed in U.S. Pat. No. 4,693,026, which issued to D. Callahan et al. on Sep. 15, 1987, and U.S. Pat. No. 4,765,080, which issued to W. Conti on Aug. 23, 1988. Both of these changeable display devices require at least partial dismantling of the apparatus in order to change the information displayed thereon. As mentioned, because display signs of this type are often preferably mounted in close proximity to service counters and other areas critical to the operation of a restaurant or similar business, display signs requiring substantial labor and/or dismantling of the sign system are inefficient and obtrusive. Heretofore, the devices available in the industry have failed to provide a sign system which provides convenient access from the front of the sign panel for easy placement and changing of individual character indicia and other information which must be changed from time to time. Prior attempts to provide front access for changing of displayed information required complex structures and/or inconvenient manipulation of indicia elements and other sign components which complicated the sign modification procedures interfered with business operations, and added to the cost of operation through increased labor and capital outlays.

DISCLOSURE OF THE INVENTION

It is an object of this invention to obviate the above-described problems and shortcomings of the display sign systems heretofore available in the industry.

It is another object of the present invention to provide an improved modular digit carrier and sign system which provides convenient front access to sign indicia, and allows insertion and removal of indicia information from the modular digit carrier without removing the carrier from the sign face.

It is also an object of the present invention to provide a display sign system which provides a sign face upon which a plurality of information digits can be secured and interchanged freely from the front surface of the sign without a need for dismantling any portion of that sign.

It is yet another object of the present invention to provide an improved modular digit carrier which can be placed closely adjacent a plurality of other modular digit carriers, and which provides convenient front access for insertion and removal of interchangeable indicia digits without dismantling any portion of the sign and without interfering with or being interfered with by the adjacent digit carriers.

In accordance with one aspect of the present invention, there is provided a modular digit carrier for a sign system having a sign face upon which a plurality of digits can be secured. In a preferred embodiment, the digit carrier includes a rear surface and a front surface, and outwardly extending flanges for securing the digit carrier with its rear surface adjacent the planar sign face. The digit carrier further includes a support channel which provide access to an interchangeable digit supported by the carrier from the front surface of the digit carrier. The support channel slidingly supports the indicia digit and permits the digit to be slidingly inserted into and/or removed from the carrier without removing the carrier from the sign face and without interfering with closely adjacent digit carriers. Additionally, the digit carrier is preferably so configured that single motion insertion (e.g. downward motion) and single motion removal (e.g. upward motion) of digits can be effected while the digit carrier is in place on the sign face.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
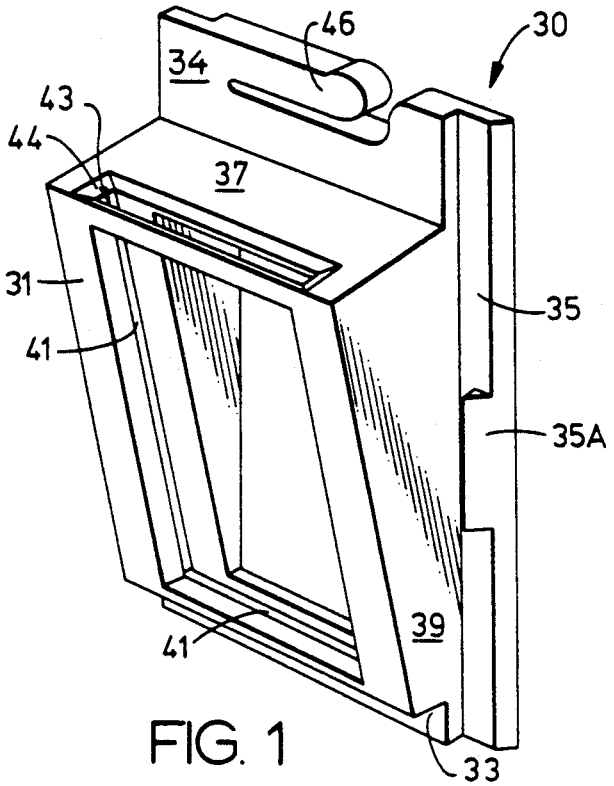
FIG. 1 is a perspective view of a preferred embodiment of a modular digit carrier made in accordance with the subject invention.
Figure 5:
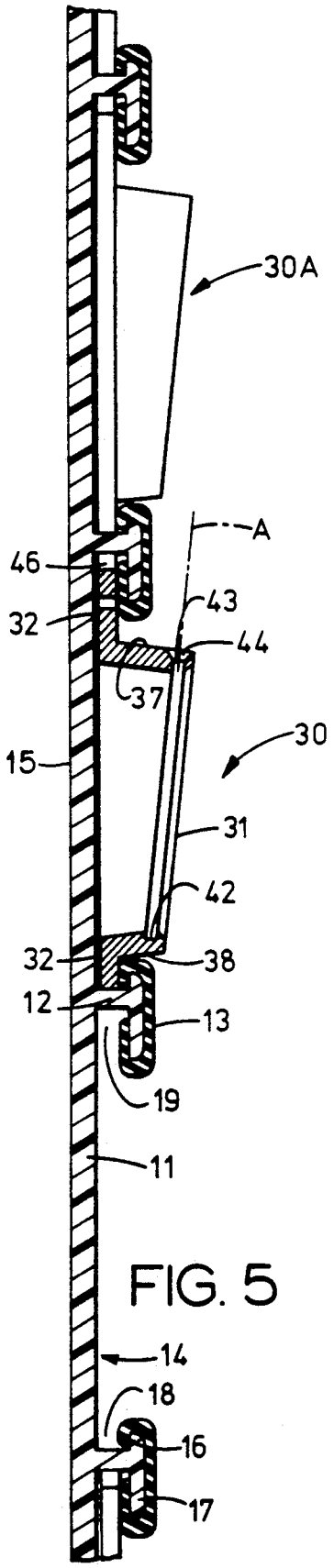
FIG. 5 is a vertical cross section of a portion of the interchangeable display sign system shown in FIG. 4, taken along line 5—5 thereof.
Figure 2:
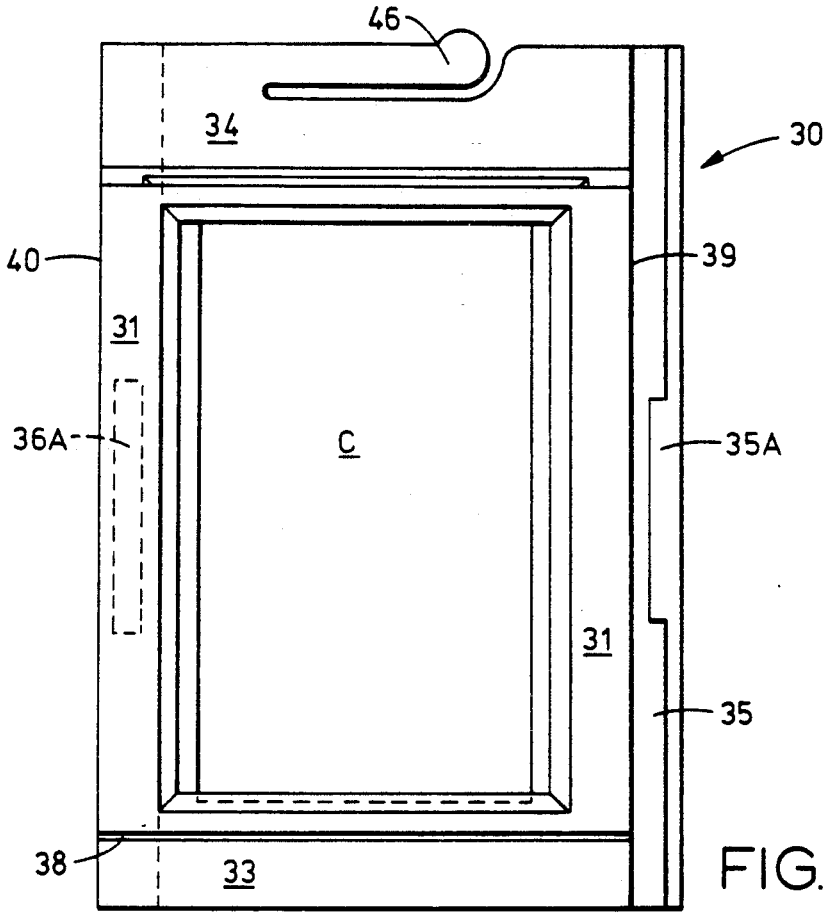
FIG. 2 is a front elevational view of the modular digit carrier of FIG. 1.
Figure 3:
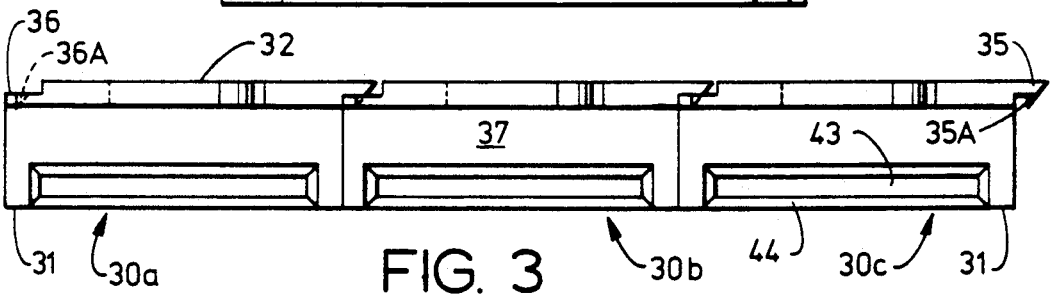
FIG. 3 is a top plan view of three adjacent modular digit carriers made in accordance with the subject invention.
Figures 4, 8:
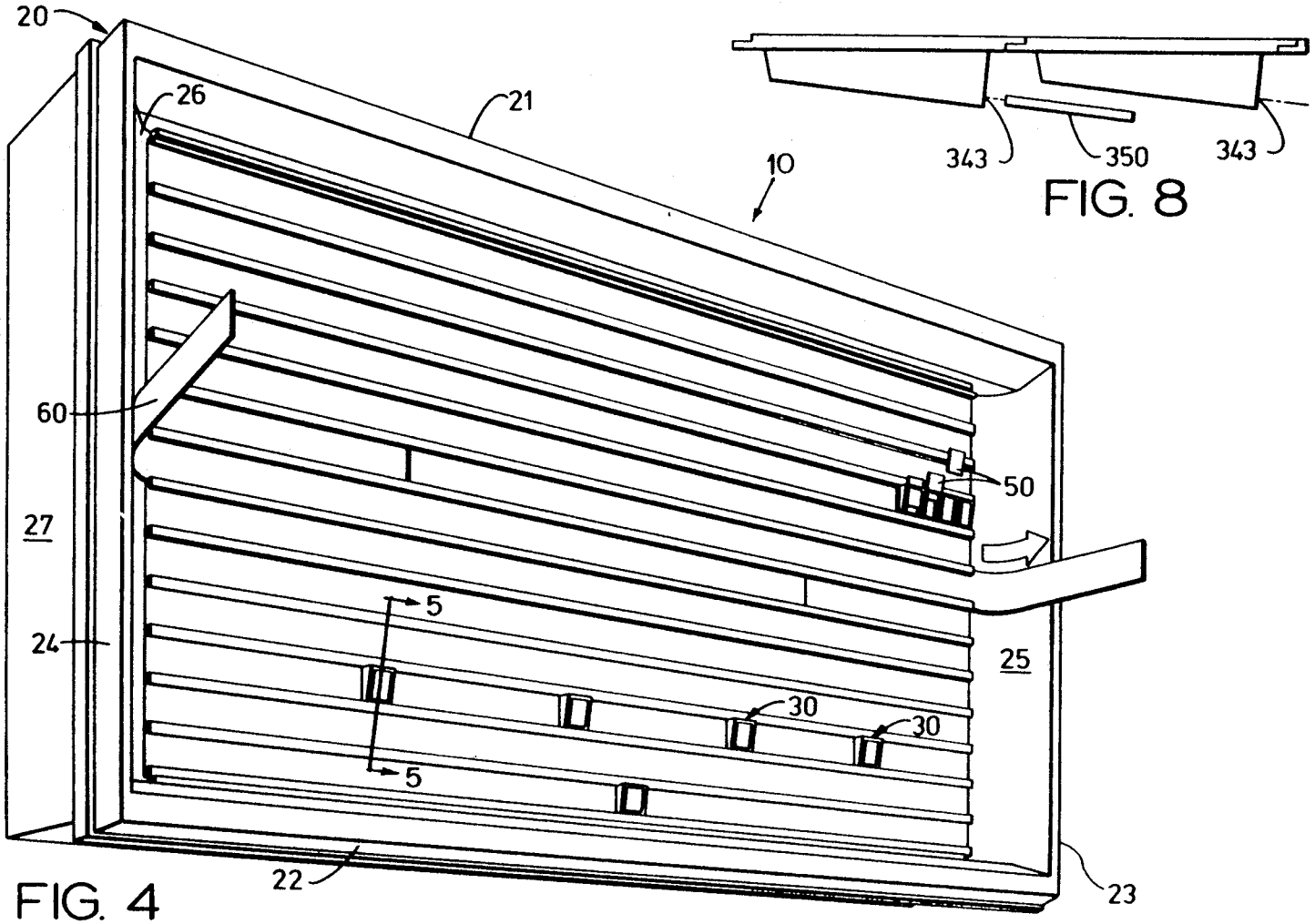
FIG. 4 is a perspective view of an interchangeable display sign system made in accordance herewith including a plurality of modular digit carriers secured adjacent the sign face.
FIG. 8 is a top plan view of a pair of modular digit carriers made in accordance herewith illustrating an alternate orientation of the carriers of the subject invention.

Referring now to the drawings in detail, wherein like numerals indicate the same elements throughout the views, FIGS. 1-3 illustrate a preferred embodiment of a modular digit carrier 30 of the present invention. As used herein, the term "modular" is intended to connote a substantially standardized unit to simplify manufacturing, shipping, storage, inventory, and use characteristics, as will be described. FIG. 4 illustrates a perspective view of an interchangeable display sign system 10 including a plurality of modular digit carriers 30 made in accordance herewith, and illustrating the versatility of such a sign system employing the unique modular digit carriers of the present invention. FIG. 5 illustrates a vertical cross sectional view of a portion of the interchangeable display sign system of FIG. 4, illustrating additional details of modular digit carrier 30 and interchangeable display sign system 10 with which digit carriers of the subject invention can be advantageously utilized.

Figure 1A:
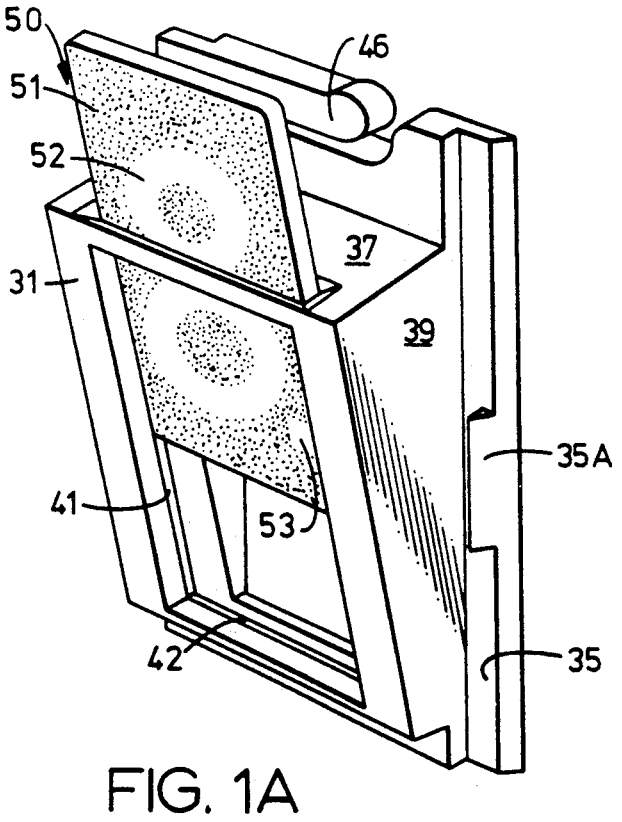
FIG. 1A is a modified perspective view of the digit carrier of FIG. 1 with an interchangeable indicia digit partially inserted therein.

As seen best in FIGS. 1, 1A and 2, modular digit carrier 30 is preferably a unitary structure having a front surface 31, and, as shown in FIG. 3, an oppositely disposed rear surface 32. As best illustrated in FIG. 5, it is contemplated that rear surface 32 can be substantially planar in nature to correspond with a substantially planar face 11 of an interchangeable display sign system 10, as will be described in greater detail below. As will be seen, however, it is not critical to this invention that these surfaces be planar. As seen in FIG. 1, rear surface 32 is preferably substantially open in its central portions to permit light to pass therethrough from behind, as in backlighted sign applications. Digit carrier 30 also comprises outwardly extending flange members 33 and 34, which in a preferred embodiment serve as means for supporting the digit carrier 30 within the longitudinal tracks 14 of interchangeable display sign system 10. While it is preferred that flange members 33 and 34 be located adjacent the top and bottom peripheral edges of rear surface 32 of digit carrier 30 in order to support digit carrier 30 in a substantially close face-to-face relationship with sign face 11, the particular means for securing digit carrier 30 adjacent the sign face is not critical and might be accomplished in a variety of ways known or conceivable in the industry according to the specific structure and mounting requirements of any particular sign face.

The main part of modular digit carrier 30 preferably comprises a frame-like body portion including a top member 37, bottom member 38, and two oppositely disposed side members 39 and 40, respectively. As illustrated in the drawings, the front and rear surfaces of body portions 37 through 40 define front surface 31 and rear surface 32, respectively, of the frame-like, modular digit carrier 30. As illustrated in FIGS. 1 and 1A, both front and rear surfaces 31 and 32 may preferably be apertured to provide maximum front visual and physical access to a digit 50, and to enable backlighting from the rear, as will be discussed. In a preferred embodiment, flanges 33 and 34 for securing digit carrier 30 adjacent sign face 11 of a display sign system have rear surfaces which are substantially coplanar with rear surface 32, however, such relationship is not critical. Again, the exact structure and location of the means for securing the rear surface of digit carrier 30 adjacent the sign face is not critical to the subject invention and could be adapted to particular sign structures, as appropriate. The inner peripheral surfaces of side members 39 and 40 and bottom member 38 include a recessed groove which defines a channel 41 for supporting an interchangeable digit panel 50 which can be slidably inserted and removed from support channel 41 through an open slot 43 formed in top member 37.

As best seen in FIGS. 1A and 5, support channel 41 is effectively closed at bottom member 38 so that an interchangeable digit panel 50 can be supported within modular digit carrier 30, and can be conveniently inserted and removed through open slot 43 as illustrated in FIGS. 1 and 1A. A taper or chamfer (e.g. 44) may be provided at slot 43 to further facilitate insertion of a panel 50. Digital manipulation of an interchangeable panel 50 is facilitated by the substantially open nature of the frame-like body of carrier 30, which allows direct access to panel 50 from the front surface 31. It should be noted that while digit carrier 30 is shown and described in a preferred arrangement with open slot 43 oriented in an upward direction, the present invention can also be implemented with slot 43 oriented to enable insertion and removal in a horizontal direction. As illustrated in FIG. 8, this can be easily accomplished by effectively rotating digit carrier 30 approximately 90° and locating flange members 33 and 34 adjacent side members 39 and 40, respectively. It is further contemplated that modular digit carriers made in accordance with the present invention could be designed for interchangeable use in a vertical or horizontal mode as desired.

Support channel 41 is illustrated in a preferred embodiment of FIGS. 1-5 as providing a relatively planar support for a substantially planar interchangeable digit panel 50. In this regard, it is contemplated that relatively rigid interchangeable digit panels 50 might be preferred for ease of manipulation, durability of the digit panels in use, storage characteristics and the like. The individual digit panels 50 can be formed of a variety of materials such as polymers, acrylics, plastics, glass, metal cardboard, or the like. While the exact material from which digit panel 50 is formed is not critical, it is preferred that such digit panels be formed from plastic or polymeric material due to its light weight, durability, low cost, and ability to make various plastic materials translucent to permit the passage of light in backlighted display sign systems.

It is quite common in the industry to backlight a display sign or menu system such as shown in FIG. 4 by providing a light source behind the sign panel which can highlight the information, illustrations, and/or other indicia attached adjacent the sign face. An example of a backlighted menu board is shown in U.S. Pat. No. 4,367,604 which was discussed above. As used herein, the term "translucent" is understood to mean that a surface permits a major portion of light incident thereon to pass through, and specifically includes transparent surfaces. Similarly, as used herein, the term "opaque" shall be understood to define a surface which blocks a major portion of the light incident thereon.

In applications where the sign system is backlighted, it will be understood that individual interchangeable digit panels 50 may include alpha-numeric indicia (e.g. 52) or other symbolic indicia or the like (e.g. 53) which is to be provided as a translucent portion, while the remaining area of digit panel 50 is substantially opaque. Alternatively, the indicia (e.g. 52 and 53) could be provided as the opaque portion, with the remaining area of panel 50 being substantially translucent, as desired. For example, an opaque layer 51 can be provided to the surface of an interchangeable digit panel 50 by painting, plating, anodizing or the like (depending on preference and materials from which digit panel 50 is made). Such opaque coating is omitted or removed from digit panel 50 to form an alpha-numeric indicia 52 and/or other indicia characters such as symbols, commas, decimal points, or the like. Obviously, digit panels coated completely with an opaque layer or formed of opaque material (i.e. having no indicia formed thereon at all) might also be used to provide an effective blank space between adjacent indicia on a display sign system 10.

As illustrated in FIG. 1A, the frame-like body portion of digit carrier 30 provides substantial access to an interchangeable digit panel 50 supported within digit carrier 30 from the front surface 31 thereof. This substantial access is preferably provided by the substantially open central area (e.g. aperture or area C shown in FIG. 2). The countersunk or recessed nature of support channel 41 not only slidably receives a digit panel 50, but further serves to ensure that light provided by a source from behind digit carrier 30 will not leak around the peripheral edges of digit panel 50 held within digit carrier 30. In this regard, as can be best seen in the illustration of FIG. 3, there is a very low probability of light leakage around the peripheral edges of a digit panel 50 supported within a digit carrier 30 as a result of the tortuous pathway for such light afforded by the interactive surfaces of these structures. Carrier 30 will preferably be made of an opaque material, or will be appropriately coated. Control and elimination of light leakage in display sign systems as shown and described herein is critical to maintaining the highest quality of appearance and function of the interchangeable digit panel and digit carriers, and has been a problem in prior art structures.

As also illustrated best in FIGS. 1A and 5, the unique structure of the modular digit carrier of the subject invention perferably permits both insertion (e.g. downward motion) and removal (e.g. upward motion) of a digit panel 50 in a convenient, single direction, uninterrupted motion through open slot 43 of top member 37. As also mentioned, by orienting the modular digit carriers of the present invention in a 90° rotated nature (see FIG. 8), the single direction, uninterrupted motion insertion/removal can be provided in a substantially horizontal direction as well. As will be described in greater detail below, the means provided in digit carrier 30 for supporting an interchangeable digit panel (e.g. 50) is to be oriented so as to support the digit panel 50 so that it can be removed in a single, uninterrupted motion through the slot formed in the frame-like body portion in a direction angularly away from the sign face of the display sign system, so that insertion and removal of individual digit panels 50 can be accomplished conveniently from the front of a display sign system and without removing the modular digit carrier from the sign face. FIG. 1A illustrates an interchangeable digit panel 50 being inserted (or removed) from a modular carrier 30 in a substantially vertical direction, and the cross-sectional view of FIG. 5 illustrates the unique non-interfering nature of the insertion/removal procedures due to the angular orientation of support channel 41 relative rear surface 32 of digit carrier 30 and sign face 11 of display sign system 10.

For example, FIG. 5 illustrates a plane A which is angularly oriented relative rear surface 32 and sign face 11 when digit carrier 30 is installed in a sign system 10, with such angled plane A oriented in a manner such that insertion and/or removal of a digit panel 50 along that plane will encounter no interference from adjacent digit carriers (e.g. a digit carrier 30A shown in profile surmounted above carrier 30) or from the structure of the display sign system 10. As will be discussed in greater detail with regard to alternate embodiments of the modular digit carrier of the present invention, it is not critical that support channel 41 be planar along its entire axial length, but it is important that support channel 41 be oriented in such a way (e.g. angularly away from the rear surface 32 and sign face 11) so that when the modular digit carrier is secured to the sign face, an interchangeable digit panel 50 being inserted or removed therefrom does not experience interference from adjacent digit carriers or sign system structures.

Figure 7:
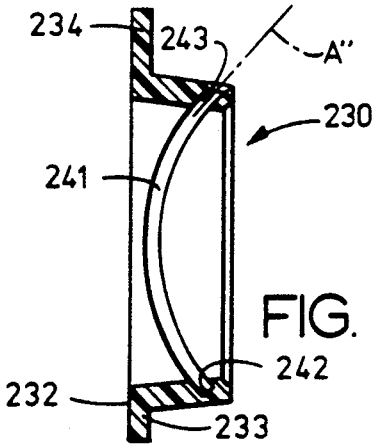
FIG. 7 is a side view in vertical cross section of yet another alternate embodiment of a modular digit carrier made in accordance with this invention.

Modular digit carrier 230 shown in FIG. 7 is an example of an embodiment wherein support channel 241 is not planar along its entire axial length from top to bottom of digit carrier 230; however, the upper portion of support channel 241 is oriented angularly away from rear surface 232 in order to provide for convenient, uninterrupted insertion or removal of a digit panel through open slot 243 in a direction indicated by plane A".

It is also not critical that the rear surface of the modular digit carrier described herein be absolutely planar in nature. While it is contemplated that the sign face upon which the modular digit carriers described herein will be secured is preferably planar in nature, such need not be the case. Further, it should be understood that while it is preferred that the modular digit carriers described herein are to be secured adjacent the sign face 11 of a display sign system, the rear surface 32 of modular digit carrier 30 need not be planar to accomplish this requirement. In this regard, as seen in FIGS. 1, 2 and 5, modular digit carrier 30 preferably includes a pair of oppositely disposed and outwardly extending flanges 33 and 34 adjacent the lower and upper portions, respectively, of its rear surface 32 for securing digit carrier 30 adjacent planar sign face 11. Flanges 33 and 34 are illustrated only as a preferred means for securing digit carrier 30 adjacent sign face 11 in a display sign system 10 including a plurality of spaced longitudinal ribs 12. It is contemplated that modular digit carriers made in accordance with the present invention could include any of a variety of means for securing the digit carrier adjacent a particular sign face, such as hooks, hangers, interacting buttons or the like, as appropriate. The display sign system 10 illustrated in FIGS. 4 and 5 is a preferred system having a substantially planar sign face 11 upon which a plurality of information indicia can be secured.

Referring now to FIGS. 4 and 5, interchangeable display sign system 10 is illustrated as comprising sign face 11 having a plurality of vertically spaced longitudinal ribs 12 extending outwardly from the front of sign face 11, with such ribs including covers or sleeves 13, and defining a plurality of vertically spaced tracks 14. Tracks 14 are intended to receive and support a plurality of modular digit carriers 30 and a plurality of flexible display strips 60 which can include a variety of information and other indicia to be displayed. In particular, it is contemplated that a preferred display sign system 10 would include flexible display strips 60 formed of plastic or similar material, with such material being translucent at least in areas where particular alpha-numeric and/or other indicia symbols are to be provided, and being opaque in nature wherever such indicia is not desired. In this way, flexible display strips 60 can provide information to be displayed on display sign system 10 such as menu items, instructions, or other information which is only infrequently changed. It is further anticipated that a plurality of modular digit carriers 30 will be used in conjunction with the flexible display strips 60 to display prices, dates, or other information which is subject to more frequent changes. As described above, the modular digit carriers 30 provide for convenient, single direction, uninterrupted motion insertion and removal of interchangeable digit panels 50 from the front surface of display sign system 10, thereby facilitating changes to the information displayed in an efficient manner.

Sign face 11 and its spaced longitudinal ribs 12 are preferably transparent to allow a major portion of light to pass therethrough in order that the sign system can be backlighted if desired. The sign face and its longitudinal ribs can be made of acrylic, polymeric or other plastic material, glass, or similar transparent materials, although plastic is preferred for its light weight, durability, and low cost. If opaque covers or sleeves 13 are utilized to cover the cantilevered protuberances or flanges 16 and 17 formed on the distal ends of ribs 12, sign face 11 and its longitudinal ribs 12 can be integrally formed of transparent material. Sleeves 13 can be made removable in case a large portion of sign face 11 is required to mount a large photographic slide or promotional displays spanning more than two ribs in vertical height, so that horizontal lines or shadows will not be seen as a result of the opaque sleeves. U.S. Pat. No. 4,367,604, described above, concerns the mounting of such large photographic slides and displays on a backlighted menu board, and provides an example of an interchangeable display sign system which might utilize the modular digit carriers of the present invention. Alternatively, of course, critical surfaces of longitudinal ribs 12 may be opacified by painting, plating, or similarly coating the same to obviate leakage of backlighting therethrough.

Sign face 11 is illustrated as having a back surface 15, and is preferably mounted within a sign frame 20, as shown in FIG. 4. Sign frame 20 can comprise top element 21, bottom element 22, and oppositely disposed side elements 23 and 24. Sign frame 20 can be formed of any appropriate material, and the manner of attachment of sign face 11 with frame 20 is not critical. As is described in greater detail in my co-pending application entitled Improved Display Sign System and filed on the same day as the present application (the disclosure of that application being hereby incorporated herein by reference), it is preferred that side frame elements 23 and 24 include surfaces 25 and 26, respectively, each having a curved conformation which is relatively flush with the front sign face 11 at the lateral edges of longitudinal tracks 14, and which flares outwardly to provide a relatively smooth cueing surface to facilitate feeding display strips 60 into the ends of longitudinal tracks 14. Both digit carrier 30 (and especially its means for securing carrier 30 to sign system 10—e.g. flanges 33 and 34) and strips 60 are so sized as to be slidably received within a track 14. In this way, front access to changing display sign system 10 is further facilitated. Additionally, in a preferred embodiment, a biasing member such as shown at 46 can be included to provide for more liberal tolerances between dimensions of respective structures of carrier 30 and tracks 14. Biasing member 46 can economically ensure uniform fit of a carrier within a sign's tracks, and improve the overall performance and quality characteristics of the system.

Sign system 10 is further shown as including sign box housing 27 which preferably encloses the rear portions of the display sign system 10 about the periphery of sign frame 20. It is contemplated that if display sign system 10 is backlighted, fluorescent light fixtures or the like can be housed within the box structure 27 behind back surface 15 of sign face 11. Obviously the size and shape of sign frame 20 and sign box or housing 27 is not critical to the present invention, and the inclusion of these structures and the particular conformation in which they are formed will depend to a large extent upon the particular application and design choices of the user.

A modular digit carrier 30 is shown as being secured within a longitudinal track 14 of sign system 10 in FIGS. 4 and 5. It is contemplated that digit carrier 30 can be inserted into a particular longitudinal track 14 from either lateral edge of that particular track, or can be inserted therein by a relatively simple insertion procedure at any point along the particular track 14. As seen best in FIG. 5, the vertically spaced longitudinal ribs 12 each have an upwardly extending cantilevered protuberance or flange 16 and a downwardly depending protuberance or flange 17 which, in conjunction with cover 13, define an upwardly facing groove or trough 18 and a downwardly extending groove or trough 19, respectively, within a longitudinal track 14. It is preferred that trough 19 be slightly deeper than the corresponding trough 18, to facilitate insertion of a modular digit carrier 30.

Insertion of a digit carrier 30 into a longitudinal track 14 can be accomplished by inserting flange 34 of digit carrier 30 into upper trough 19 of a longitudinal track 14 and sliding the digit carrier upwardly into groove 18 until the lower edge of flange 33 clears the upper edge of protuberance 16 (or the upper edge of sleeve 13 covering protuberance 16). Then the digit carrier 30 is simply pressed toward planar sign face 11, thereby bringing rear surface 32 adjacent planar sign face 11 so that flange 33 can be lowered into trough 18. Following this procedure, digit carrier 30 will be secured within longitudinal track 14 as shown in the cross-sectional view of FIG. 5. Where a biasing member (e.g. 46) is incorporated, the bias of member 46 will enable carrier 30 to fit snugly within a track. In particular, as described above, the preferred embodiment of digit carrier 30 includes flanges 33 and 34 adjacent rear surface 32 for securing digit carrier 30 within a longitudinal track 14 of a display sign system 10 adjacent sign face 11. Biasing member 46 can be included on either or both of flanges 33 and 34.

Removal of a digit carrier 30 from a secured position within a longitudinal track 14 can be accomplished simply by reversing this procedure. Particularly, digit carrier 30 is simply slid upwardly into groove 19 until the lower edge of flange 33 clears the top edge of cantilevered protuberance 16 (or sleeve 13 covering protuberance 16), then the lower portions of the digit carrier 30 are moved outwardly until flange 33 is outside of the track 14. Where a biasing member 46 is included on carrier 30, this upward sliding motion will compress biasing member 46. After moving flange 33 out of track 14, the digit carrier 30 can be removed by sliding flange 34 downwardly and out of groove 19. In this way, individual digit carriers 30 can be conveniently inserted into or removed from a longitudinal track 14 of sign face 11 at any point therealong Once secured adjacent the sign face 11, the modular digit carrier 30 provides a unique support means for interchangeable digit panels 50, wherein a panel 50 can be conveniently inserted and removed therefrom in a simple, single, uninterrupted procedure from the front face of the sign without removing the digit carrier from the sign face 11.

It is often desirable to place a plurality of modular digit carriers 30 adjacent one another at various points on planar sign face 11. FIG. 4 shows an example of four modular digit carriers 30 being placed adjacent one another within a single longitudinal track 14. FIG. 3 is a top view illustration of three modular digit carriers made in accordance with the subject invention which are arranged directly adjacent one another in seriatim. As mentioned above, obviating leakage of light from a backlighted sign system is very important to providing a high quality, high resolution sign system. When a plurality of digit carriers are arranged directly adjacent one another, it is important to ensure that light will not leak between the contiguous edges of adjacent carriers. In order to obviate the potential for light leakage therebetween, it is preferred that the oppositely disposed edges (e.g. edges 35 and 36) of a modular digit carrier 30 made in accordance herewith be complementarily configured in order to provide a predetermined amount of nesting (i.e. overlap and/or interlocking) interaction between adjacent carriers.

FIGS. 1-3 illustrate a preferred embodiment of a digit carrier 30 in which flange 35 is formed with a vertical nesting member or tongue 35A designed to mate with a complementary nesting groove (e.g. 36A) formed along the corresponding lateral edge 36 of the adjacent digit carrier, and wherein flange 35 is designed to overlap with and be received within corresponding recess 36. In this way, adjacent modular digit carriers (i.e. carriers 30*a*, 30*b*, and 30*c*) form double overlapping and/or interlocking structures along their contiguous edges to obviate the possibility of light leakage therebetween.

It is contemplated that the interacting surfaces such as flange 35 and corresponding recess 36 might serve to effectively lock adjacent digit carriers together as a unit which could be slidably moved along a longitudinal track 14 as desired. The exact structure for providing such an interlocking arrangement is not critical to the subject invention and can be provided by a variety of means such as corresponding locking tongue 35A and lock groove 36A designed to detachably connect two adjacent modular carriers, as shown. This complementary interlocking or nesting feature also can provide a camming force (i.e. front to back) which acts to hold the nested carriers in place within a longitudinal track 14. In particular, the interaction of tongue 35A and groove 36A tends to more snugly hold a pair of carriers in a track 14 by slightly increasing the effective thickness of the carriers (front to back) within a track. The resulting friction tends to hold the carriers in place.

The standardized or modular nature of the digit carrier 30 of the subject invention ensures that each digit carrier can be used in conjunction with adjacent digit carriers, and simplifies the use of these digit carriers in conjunction with a display sign system, while minimizing the number of different parts required for implementation of an effective sign system. By making all of the digit carriers substantially identical in structure, inventory requirements can be simplified and reduced, and training required for users of the system can be minimized. As should be understood, because of the unique structure of the modular digit carrier of the subject invention, all installation and changes needed to establish and maintain a display sign system 10, as shown and described, can be accomplished from the front of the sign system without a need for dismantling or otherwise accessing the interior of the sign housing.

Figure 6:
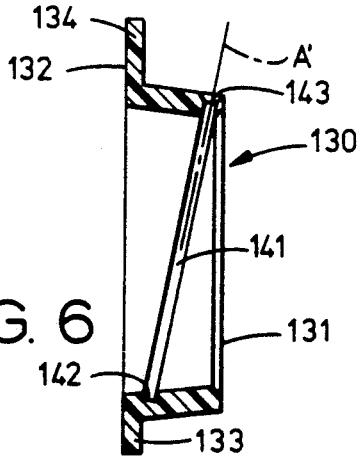
FIG. 6 is a side view in vertical cross section of an alternate embodiment of a modular digit carrier made in accordance with the subject invention.

FIG. 6 illustrates an alternate embodiment of the modular digit carrier of the subject invention, and features a digit carrier 130 having a rear surface 132, and flanges 133 and 134 for securing digit carrier 130 within a longitudinal track of a display sign system. Front surface 131 of digit carrier 130 is substantially parallel with rear surface 132, while support channel 141 is angularly oriented from its closed bottom portion 142 in an upward and outward direction away from rear surface 132. Support channel 141 is designed to slidingly support an interchangeable digit panel (not shown), and to allow convenient insertion and removal of an interchangeable digit panel along a substantially planar axis A'.

It is contemplated that a digit carrier such as illustrated in FIG. 6 having a front surface 131 substantially parallel to its rear surface 132 may facilitate shipping, handling and storage of a plurality of modular digit carriers 130 by providing a more stackable overall shape. In this regard, modular digit carriers 130 might be designed so that the front surface 131 of one modular carrier could be nested within the rear surface 132 of another modular carrier 130 to enable stacking of a plurality of such carriers, thereby minimizing space requirements and facilitating handling procedures.

To facilitate the nesting characteristics of such modular digit carriers made in accordance herewith, it is further contemplated that the top member (e.g. 37 of FIG. 2), bottom member (e.g. 38), and side members (e.g. 39 and 40) of the frame-like body portion might be tapered inwardly from adjacent the rear surface (e.g. 32) toward front surface (e.g. 31). The stackability or nesting features of digit carriers is not critical to the subject invention, and can be accomplished by a variety of structural modifications known or obvious to one skilled in the art.

As mentioned above, FIG. 7 illustrates yet another embodiment of a modular digit carrier made in accordance herewith, wherein support channel 241 is nonplanar (e.g. arcuate) in conformation from its closed bottom portion 242 to its open slot 243. As described above, modular digit carrier 230 provides a support channel 241 which does not support an interchangeable digit panel in a single plane (i.e. an interchangeable digit panel is slidably supported within support channel 241 in an arcuate or curved shape). This embodiment is merely to illustrate that the interchangeable digit panel (not shown in FIG. 7) need not be planar or, for that matter, rigid. A flexible digit panel could equally be inserted into support channel 241, and the arc or conformation of 241 need not be constant.

For example, if a flexible digit panel were to be inserted within support channel 241, the lower portions of support channel 241 could be planar, arcuate, undulating, or any variety of conformations desired, as long as the upper portions of support channel 41 supported the digit in a plane which is oriented in such a way (e.g. angularly away from the rear surface 232) that the digit panel could be slidingly inserted or removed from the carrier 230 without interfering with adjacent digit carriers or display sign system structures. As described, this is important to ensure convenient front changeability of the sign system in a multi-tiered format where digits must be placed in close vertical and horizontal proximity adjacent one another. While it is preferred that the interchangeable digit panels take a relatively rigid form to facilitate insertion, removal, manufacturing and storage procedures, in particular applications it may be preferred to utilize flexible digits as described above.

As mentioned above, FIG. 8 illustrates a top view of a pair of modular digit carriers having their open slots (e.g. 343) oriented so as to enable insertion/removal of digits (e.g. 350) in a horizontal direction. While it is preferred to insert and remove digits from an open upper slot such as shown and described above (such as the embodiment shown in FIGS. 1–3), there may be specific applications where insertion/removal in a lateral direction might be desired.

Having shown and described the preferred embodiments of the present invention, further adaptions of the modular digit carrier and interchangeable display sign system described herein can be accomplished by appropriate modifications by one of ordinary skill in the art without departing from the scope of the present invention. Several of such potential modifications have been mentioned, and others will be apparent to those skilled in the art. For example, it is not critical that the modular digit carrier of the present invention be mountable specifically between two directly adjacent longitudinal ribs, as it might be desirable to provide modular digit carriers of varying sizes which could be adapted to span between more than two adjacent ribs. Accordingly, the scope of the present invention should be considered in terms of the following claims and is understood not to be limited to the details of structure and operation shown and described in the specification and drawings.

I claim:

1. A modular digit carrier for a sign system having a sign face upon which a plurality of interchangeable sign digits can be secured, said digit carrier comprising:

(a) a rear surface and a front surface;

(b) means for interchangeably securing the digit carrier adjacent a sign face of a sign system in close vertical and horizontal proximity with adjacent digit carriers; and (c) means for supporting an interchangeable digit for slidable insertion and removal from said carrier and said sign system without removing said carrier from the sign face and without interference with or from adjacent digit carriers or sign system structure, said supporting means having a substantially open central portion to provide access to a digit supported by said carrier from the front surface thereof, and comprising a support channel adjacent said front surface having a substantially closed end and an oppositely disposed open slot spaced from said rear surface and through which an interchangeable digit is inserted and removed, at least a portion of said support channel adjacent said open slot fixed in an angular orientation outwardly and away from said rear surface, whereby said digit can be slidingly inserted and removed from said carrier through said slot along a substantially planar axis angled away from said rear surface.

2. The modular digit carrier of claim 1, wherein substantially the entire support channel between said closed end and said open slot is oriented outwardly away from said rear surface and thereby allows an interchangeable digit to be inserted into or removed from said digit carrier in a single direction and in a substantially, uninterrupted motion without interference from another digit carrier or sign system structure adjacent said open slot.

3. The modular digit carrier of claim 1, wherein said digit carrier further comprises a substantially frame-like body portion in which is formed said support channel, said support channel having a substantially closed end oppositely disposed from said open slot for insertion and removal of an interchangeable digit.

4. The modular digit carrier of claim 3, wherein said substantially closed end is located adjacent the bottom of said support channel and said open slot is adjacent the top of said support channel, enabling removal of an interchangeable digit in a direction upwardly and away from the rear surface.

5. The modular digit carrier of claim 3, wherein said substantially frame-like body portion comprises oppositely disposed side edges which are complimentarily configured to provide for close nesting between adjacent carriers in use.

6. The modular digit carrier of claim 1, wherein said support channel slidably supports an interchangeable digit in a substantially planar orientation which is angled away from said rear surface.

7. The modular digit carrier of claim 1, wherein said support channel slidably supports an interchangeable digit in a non-planar conformation, and wherein the upper portion of said support channel adjacent said slot is oriented upwardly and away from said rear surface.

8. The modular digit carrier of claim 7, wherein said support channel has a curved conformation along its axial length.

9. The modular digit carrier of claim 1, said digit carrier further comprising means for nesting said digit carrier with another directly adjacent digit carrier.

10. The modular digit carrier of claim 1 further comprising means for permitting light to pass through said digit carrier from behind a digit supported by said digit carrier.

11. A modular digit carrier for a sign system having a sign face upon which a plurality of interchangeable sign digits can be secured, said digit carrier comprising:

(a) a rear surface and a front surface;

(b) means for interchangeably securing the digit carrier adjacent a sign face of a sign system in close vertical and horizontal proximity with adjacent digit carriers; and (c) means for supporting an interchangeable digit and enabling insertion and removal of the interchangeable digit from said digit carrier and said sign system in a single direction, uninterrupted motion without removing said digit carrier from said sign face and without interference from or with adjacent digit carriers or sign system structure, said supporting means comprising a frame-like body portion having top, bottom, and oppositely disposed side members and being substantially open in its central area to provide access to a digit supported by said carrier from the front surface thereof, and a support channel formed in said frame-like body for slidably supporting an interchangeable digit, the upper portions of said support channel oriented angularly outwardly and away from said rear surface and comprising an open slot formed through said top member through which said interchangeable digit is inserted and removed.

12. The modular digit carrier of claim 11, wherein said support channel is comprised of a recessed groove formed about the inner periphery of said frame-like body portion, the bottom end of said support channel being substantially closed and the top end including said open slot through which an interchangeable digit is inserted and removed.

13. The modular digit carrier of claim 11, wherein said open slot is spaced outwardly from said rear surface to provide for clearance by an interchangeable digit being inserted into or removed from said digit carrier of adjacent digit carriers and sign structure.

14. The modular digit carrier of claim 13, wherein said support channel is designed to slidably support an interchangeable digit in a substantially planar orientation which is angled upwardly and away from said rear surface.

15. The modular digit carrier of claim 13, wherein said support channel slidably supports an interchangeable digit in a non-planar conformation.

16. The modular digit carrier of claim 15, wherein said support channel has a curved conformation along its axial length from a substantially closed bottom end to its top end.

17. An interchangeable display sign system, comprising:

(a) a plurality of interchangeable display digits;

(b) a sign face;

(c) a plurality of longitudinal tracks on said sign face, said tracks being spaced and configured to slidably receive a plurality of modular digit carriers in close adjacent relation;

(d) a plurality of modular digit carriers, said digit carriers each further comprising a rear surface, a front surface, and means for slidably securing said digit carriers between two adjacent spaced longitudinal tracks such that said rear surface is adjacent said sign face and said digit carriers can be secured in close vertical and horizontal proximity to one another; and (e) said digit carriers each further comprising means for supporting an interchangeable digit for slidable insertion and removal from said carrier and said sign system without removing said carrier from the sign face and without interference with or from adjacent digit carriers or sign system structure, said supporting means having a substantially open central portion to provide access to a digit supported by said carrier from the front surface thereof, and comprising a support channel adjacent said front surface having a substantially closed end and an oppositely disposed open slot through which an interchangeable digit is inserted and removed, at least a portion of said support channel adjacent said open slot fixed in an angular orientation outwardly and away from said rear surface whereby said digit can be slidingly inserted and removed from said carrier along a substantially planar axis angled away from said rear surface.

18. The interchangeable display sign system of claim 17, said sign system designed to accommodate a plurality of modular digit carriers which can be secured adjacent said sign face in a plurality of vertical tiers within said spaced longitudinal tracks, said supporting means of each modular digit carrier providing convenient single direction, uninterrupted motion insertion and removal of interchangeable display digits via said support channel without interference with adjacent digit carriers or sign system structure.

19. The interchangeable display sign system of claim 17, wherein said sign face and said longitudinal tracks are integrally formed of a translucent material to permit backlighting of said system, and wherein said system further comprises opaque means for covering the distal portions of said longitudinal tracks to prevent leakage of backlighting therethrough.

* * * * *